US009004224B2

(12) United States Patent
Uzawa

(10) Patent No.: US 9,004,224 B2
(45) Date of Patent: Apr. 14, 2015

(54) EXHAUST SYSTEM OF SADDLE-RIDE TYPE VEHICLE

(71) Applicant: Honda Motor Co., Ltd., Tokyo (JP)

(72) Inventor: Yuki Uzawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/037,516

(22) Filed: Sep. 26, 2013

(65) Prior Publication Data

US 2014/0090926 A1 Apr. 3, 2014

(30) Foreign Application Priority Data

Sep. 28, 2012 (JP) ..... 2012-217665

(51) Int. Cl.
*F01N 1/08* (2006.01)
*F01N 13/08* (2010.01)

(52) U.S. Cl.
CPC *F01N 1/08* (2013.01); *F01N 13/08* (2013.01); *F01N 2340/04* (2013.01); *F01N 2590/04* (2013.01)

(58) Field of Classification Search
USPC ..... 181/227, 228, 205, 282, 283
See application file for complete search history.

(56) References Cited

U.S. PATENT DOCUMENTS 5,036,947 A * 8/1991 Metzger ..... 181/241
5,474,123 A * 12/1995 Buckshaw ..... 165/134.1
6,026,930 A * 2/2000 Ogisu et al. ..... 181/228
6,438,949 B1 * 8/2002 Nozaki ..... 60/322
6,702,062 B2 * 3/2004 Kusabiraki et al. ..... 181/240
7,374,016 B2 * 5/2008 Yamaguchi et al. ..... 181/249
7,434,656 B2 * 10/2008 Yasuda et al. ..... 181/227
7,946,380 B2 * 5/2011 Yamamoto et al. ..... 181/227
2006/0065480 A1 * 3/2006 Leehaug ..... 181/283

FOREIGN PATENT DOCUMENTS

JP 06101470 A * 4/1994 ..... F01N 7/14
JP 3622114 B2 12/2004
JP 2005105959 A * 4/2005 ..... F01N 7/20

* cited by examiner

*Primary Examiner* — Jeremy Luks
(74) *Attorney, Agent, or Firm* — Birch, Stewart, Kolasch & Birch, LLP

(57) ABSTRACT

An exhaust system of a saddle-ride type vehicle includes engagement units to improve the exterior design of a muffler cover and a muffler cover for an excellent appearance that can be easily and reliably attached. A cylindrical muffler is connected to an exhaust pipe for exhausting exhaust from an engine E. A front cap is provided on a front side of a muffler body portion. A muffler cover covers part of the exhaust pipe and the front cap. In the exhaust system, multiple engagement units respectively include multiple engagement receiving parts and multiple engagement claw parts. The engagement receiving parts are provided on an outer surface wall of the front cap with an interval therebetween in a circumferential direction about a muffler center axis of the muffler. The engagement claw parts corresponding respectively to the multiple engagement receiving parts and are disposed on a back surface of the muffler cover.

19 Claims, 11 Drawing Sheets

EXHAUST SYSTEM OF SADDLE-RIDE TYPE VEHICLE

CROSS-REFERENCE TO RELATED APPLICATIONS

The present application claims priority under 35 USC 119 to Japanese Patent Application No. 2012-217665 filed Sep. 28, 2012 the entire contents of which are hereby incorporated by reference.

BACKGROUND OF THE INVENTION

1. Field of the Invention

The present invention relates to an exhaust system of a saddle-ride type vehicle. More particularly, to an exhaust system of a saddle-ride type vehicle that includes a muffler cover covering a muffler and an exhaust pipe.

2. Description of Background Art

A muffler for a conventional saddle-type motorcycles is known wherein a muffler cover is provided in a front portion of a muffler provided on the rear side of an exhaust pipe for exhausting a combustion gas in order to improve the appearance. See, for example, Japanese Patent No. 3622114.

An attachment structure of a muffler cover disclosed in Japanese Patent No. 3622114 is a structure including an engagement member formed of plate-shaped protrusions protruding in a muffler axis direction from an end plate near an outer peripheral surface of a muffler body portion and insertion openings provided in a rear end portion of the muffler cover.

The muffler cover is attached by the engagement between the plate-shaped protrusions and the insertion openings. However, since the plate-shaped protrusions are provided near the outer peripheral surface of the muffler body portion, the plate-shaped protrusions are exposed to the outside and may deform if an external force is applied to the engagement member. Moreover, the plate-shaped protrusions have such a structure that the plate-shaped protrusions extending in the muffler axis direction are provided in an outer peripheral edge of the muffler body portion. The plate-shaped protrusions thus have a problem in terms of strength. To counter this problem, the shape of the conventional engagement member is increased in size, thereby increasing the stiffness. As a result, there is a problem wherein the shape of the muffler cover is affected by the structure of the engagement member for attaching the muffler cover. Thus, the freedom in exterior design is thereby impaired.

Moreover, a structure in which part of the engagement member is exposed is not preferable in terms of appearance. However, a structure in which the engagement member is completely covered with the muffler cover has a problem that the attachment work thereof is difficult. In this respect, there is a demand for a structure of a muffler cover which is excellent in appearance and which can be easily and reliably attached.

SUMMARY AND OBJECTS OF THE INVENTION

The present invention has been made in view of the circumstances described above and has an object of an embodiment to provide an exhaust system of a saddle-ride type vehicle including engagement units capable of improving the freedom in exterior design of a muffler cover and a muffler cover which is excellent in appearance and which can be easily and reliably attached.

For the purpose of achieving the above-mentioned object, according to an embodiment of the present invention, an exhaust system of a saddle-ride type vehicle includes a cylindrical muffler connected to an exhaust pipe for exhausting exhaust from an engine and provided with a front cap on a front side of a muffler body portion that has a muffler cover covering part of the exhaust pipe and the front cap. In the exhaust system, multiple engagement units are provided that are formed respectively of multiple engagement receiving parts and multiple engagement claw parts. The engagement receiving parts are provided on an outer surface wall of the front cap with an interval therebetween in a circumferential direction about a muffler center axis of the muffler, the engagement claw parts corresponding respectively to the multiple engagement receiving parts and being disposed on a back surface of the muffler cover.

According to an embodiment of the present invention, insertion openings extending along the muffler center axis in a vehicle front-rear direction are provided in the respective engagement receiving parts. Claw portions, configured to be inserted into the insertion openings, are provided in the respective engagement claw parts. Guide portions are provided on front sides of the respective insertion openings with the guide portions being configured to guide the claw portions to the insertion openings and continuous with the insertion openings.

According to an embodiment of the present invention, the insertion openings are respectively provided with stopper portions on a front side thereof in an insertion direction of the engagement claw parts, the stopper portions are configured to restrict the insertion amounts of the engagement claw parts.

According to an embodiment of the present invention, two of the engagement units are provided. In a view in the vehicle front-rear direction, both of the engagement units are disposed on a vehicle outer side of a vertical line passing through the muffler center axis with one of the engagement units being disposed above a horizontal line passing though the muffler center axis while another engagement unit is disposed below the horizontal line.

According to an embodiment of the present invention, the two engagement units are disposed at an interval of substantially 90° in the circumferential direction about the muffler center axis.

According to an embodiment of the present invention, the exhaust pipe extends to one side in a vehicle left-right direction, and then extends across a vehicle center to another side. A muffler coupling pipe portion of the exhaust pipe is disposed on the same side as the muffler is covered with the muffler cover.

According to an embodiment of the present invention, the exhaust pipe enters an insertion hole formed on a vehicle lower side of the front cap, in a direction intersecting the muffler center axis, and is coupled to a muffler front end portion while extending along the muffler center axis.

According to an embodiment of the present invention, the insertion hole is located at a position on a lower half side of the muffler in a vertical direction and on an inner side thereof in a vehicle width direction.

According to an embodiment of the present invention, the front cap has a dividing portion at which the front cap is divided into two parts substantially along the muffler center axis, and the insertion hole is formed to extend across the dividing portion.

According to an embodiment of the present invention, the engagement receiving parts are formed on the outer surface wall of the front cap and the installation area of the engagement receiving parts is thereby increased. Accordingly, the stiffness of the engagement receiving parts can be easily increased and the muffler cover can be thus firmly fixed. Moreover, since the entire engagement claw parts are disposed on the back surface of the muffler cover, the engagement units can be reliably protected. Furthermore, since the engagement receiving parts can be increased in size and formed stiff, the engagement claw parts formed on the muffler cover can be reduced in size. Accordingly, the engagement claw parts can be formed at any positions irrespective of the shape of the muffler cover. As a result, the freedom in shape of the muffler cover can be improved together with the freedom in installation positions of the engagement claw parts.

According to an embodiment of the present invention, the claw portions of the engagement claw parts on the muffler cover are configured to be inserted into the insertion openings of the engagement receiving parts and the guide portions continuous with the insertion openings in the front-rear direction are provided on the front sides of the insertion openings. Accordingly, when the muffler cover is attached, the claw portions of the engagement claw parts can be positioned by being brought into contact with the guide portions. Moreover, the engagement claw parts can be inserted into the insertion openings by sliding on the guide portions. This improves the mountability.

According to an embodiment of the present invention, the stopper portions restricting the insertion amounts of the engagement claw parts are provided in the insertion openings. Accordingly, the engagement claw parts can be inserted by a proper amount in the attachment of the muffler cover and completion of the insertion operation can be recognized by the contact of the engagement claw parts with the stopper portions. This can improve the mountability.

According to an embodiment of the present invention, the two engagement units are both formed on the vehicle outer side to be distributed respectively on the upper and lower sides. Accordingly, the engagement units can be easily visually checked in mounting the muffler cover and the mountability is thus improved.

According to an embodiment of the present invention, the engagement units are disposed at an interval of substantially 90° in the circumferential direction about the muffler center axis C1, and can thereby support the muffler cover with a large interval therebetween in a horizontal cross-section direction of the muffler cover. Accordingly, their force for supporting the muffler cover can be increased.

According to an embodiment of the present invention, the exhaust pipe is routed to extend to the one side in the vehicle left-right direction, and then extend across the vehicle center to the other side. Thus, a sufficient exhaust pipe length can be thereby secured. Moreover, since the muffler coupling pipe portion of the thus-routed exhaust pipe is covered with the muffler cover on a vehicle lateral surface on the same side as the muffler, the exhaust pipe can be made invisible and the appearance of the vehicle can be thus improved.

According to an embodiment of the present invention, the exhaust pipe enters the front cap from the vehicle lower side of the front cap in the direction intersecting the muffler center axis and is coupled to the muffler front end portion while extending along the muffler center axis. Accordingly, a sufficient exhaust pipe length is secured and this contributes to improvement in the output characteristics of the engine. Moreover, since the exhaust pipe has such a structure that a sufficient exhaust pipe length can be secured in the vertical direction, there is no need to dispose the muffler on the vehicle outer side to secure the sufficient exhaust pipe length. Accordingly, the muffler can be disposed closer to the vehicle center.

According to an embodiment of the present invention, the insertion hole through which the exhaust pipe is inserted is located at the position on the vehicle lower side and on the vehicle inner side, and the coupling portion between exhaust pipe and the muffler can be thus disposed to be less visible. Accordingly, the lateral surface shape on the side on which the muffler cover is mounted can be made simple and complexity of the shape of the muffler cover is avoided. This can contribute to an improvement in appearance.

According to an embodiment of the present invention, the exhaust pipe is inserted into the insertion hole extending across the dividing portion and dividing the front cap into two parts. This contributes to an improvement in the mountability of the exhaust pipe.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
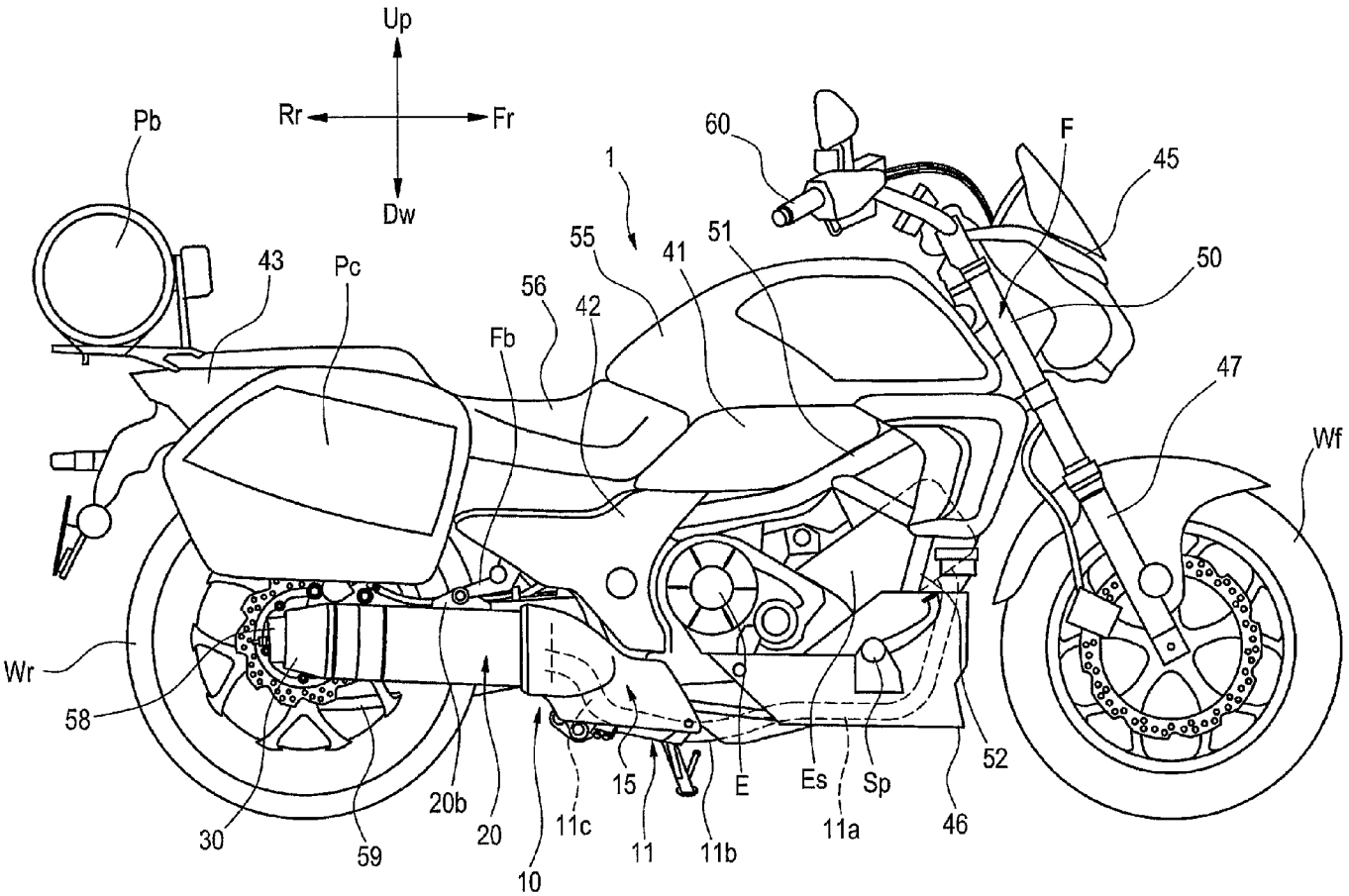
FIG. 1 is a right-side view of a saddle-ride type vehicle including an exhaust system of the present invention.

An embodiment of the present invention is described below.

A motorcycle that is a saddle-ride type vehicle is an embodiment of the present invention as described in detail with reference to FIGS. 1 to 11.

Note that the drawings are to be viewed in a direction in which reference numerals can be read correctly. Moreover, directions with respect to the travelling direction of the motorcycle are shown in the drawings, in which Fr denotes a forward direction, Rr denotes a rearward direction, Up denotes an upward direction, Dw denotes a downward direction, L denotes a leftward direction, and R denotes a rightward direction.

Figure 2:
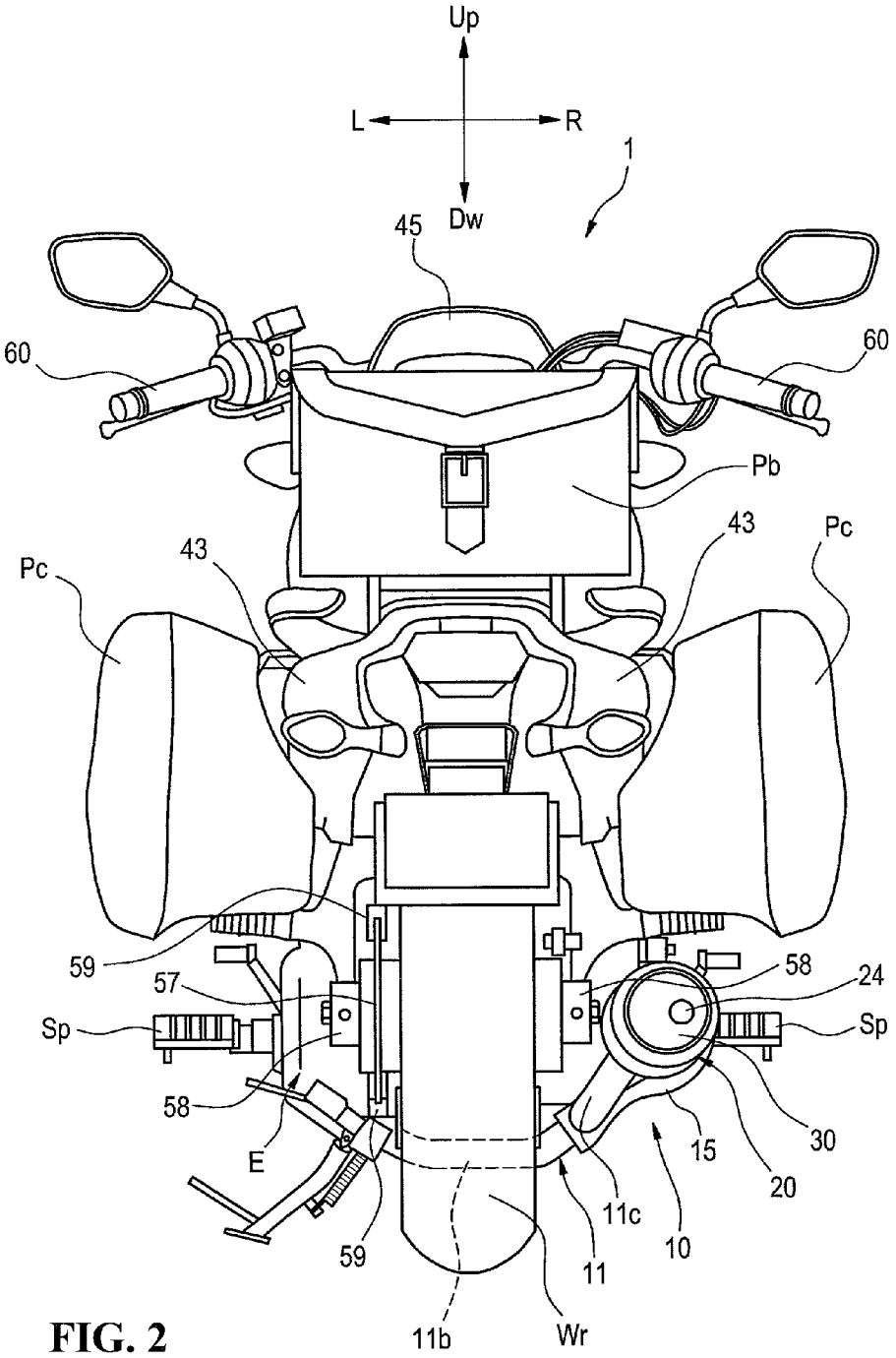
FIG. 2 is a back view of the saddle-ride type vehicle shown in FIG. 1 as viewed from the back.

FIG. 1 shows a side view of a motorcycle 1 of the embodiment as viewed from the right side and FIG. 2 shows a back view of the motorcycle 1 as viewed from the back side.

The motorcycle 1 has a structure in which constituent parts are attached to a vehicle body frame F serving as a framework. More specifically, the vehicle body frame F is provided with a head pipe 50 in a vehicle front end portion and includes a pair of main frames 51, 51 that extend to, for example, left and right from the head pipe 50 and that extend rearwardly while inclining downwardly toward the rear. The vehicle body frame F is also provided with down tubes 52, 52 extending toward the bottom and rear of the vehicle body below the main frames 51, 51 and seat rails (not illustrated) extending obliquely upwardly toward the rear of the vehicle from rear end portions of the main frames 51, 51. An engine E is held between the main frames 51, 51 and the down tubes 52, 52.

A front fork 47 supporting a front wheel Wf is steerably supported by the head pipe 50 and a steering handlebar 60 is coupled to an upper portion of the front fork 47. A rear wheel Wr is rotatably held by a swingarm 58 that is swingably attached to the vehicle body frame F behind the engine and which is vertically swingably supported by a rear fork (not illustrated). A drive force of the engine E is transmitted to a sprocket 57 (see FIG. 2) via a chain 59 and the sprocket 57 is thereby driven.

An exterior of the motorcycle 1 in the embodiment is covered with a vehicle body cover as appropriate. More specifically, the exterior of the motorcycle 1 is covered as appropriate with a front cover 45 covering a portion at a vehicle front end side of the head pipe 50, a front side cover 41 covering a lower side of a fuel tank 55, a side cover 42 covering a portion behind the engine, a bottom cover 46 covering a lower side of the engine, and a rear side cover 43 covering a portion below a rider seat 56.

The fuel tank 55 is held above the main frames 51, 51. The rider seat 56 behind the fuel tank 55, pannier cases Pc, Pc disposed on left and right sides of an upper portion of the rear wheel Wr, a back case Pb at a rearmost end of the vehicle, and the like are provided on the seat rails via brackets as needed. As described above, the motorcycle 1 of the embodiment is provided with many storage cases and is a type of vehicle in which foot rests Sp for placing the foots during riding are disposed closer to the front of the vehicle and the rider rides in a relatively relaxed posture and which is thereby suitable for touring and the like.

An exhaust system 10 in the embodiment includes an exhaust pipe 11 extending toward the rear of the vehicle from the engine E and a muffler 20 connected to a rear end of the exhaust pipe 11. As shown in FIGS. 1 and 2, the muffler 20 extends toward the rear of the vehicle, below the pannier case Pc on the right side of the rear wheel Wr, in parallel to the swingarm 58. Moreover, an end cap 30 whose diameter becomes smaller toward the vehicle rear end is mounted at a rearmost end of the muffler 20.

The exhaust pipe 11 of the exhaust system 10 includes a left extending portion 11*a* (see FIG. 1) that is connected to an exhaust port of a cylinder portion Es located in a front portion of the engine E and which extends toward the rear of the vehicle on the lower side of the engine E and on the vehicle left side. The left extending portion 11*a* is connected to the muffler 20 via a rightward-curving portion 11*b* (see FIG. 2) curving toward the right side of the vehicle near a point where the exhaust pipe 11 passes beyond a space under the engine E and a muffler coupling pipe portion 11*c* (see FIGS. 2 and 3) that is a rising portion rising while curving upwardly and rearwardly. In other words, the exhaust pipe 11 has a substantial S-shape extending from the engine front left side to the engine rear right side to cross the left-right vehicle center in a plan view. Accordingly, a sufficient exhaust pipe length is secured for contributing to an improvement in the output characteristics of the engine.

Furthermore, since the muffler coupling pipe portion 11*c* vertically extends and the sufficient exhaust pipe length is thus secured in the vertical direction, there is no need to dispose the muffler 20 on the vehicle outer side to secure a sufficient exhaust pipe length. As a result, the muffler 20 can be disposed closer to the vehicle center.

Figure 4:
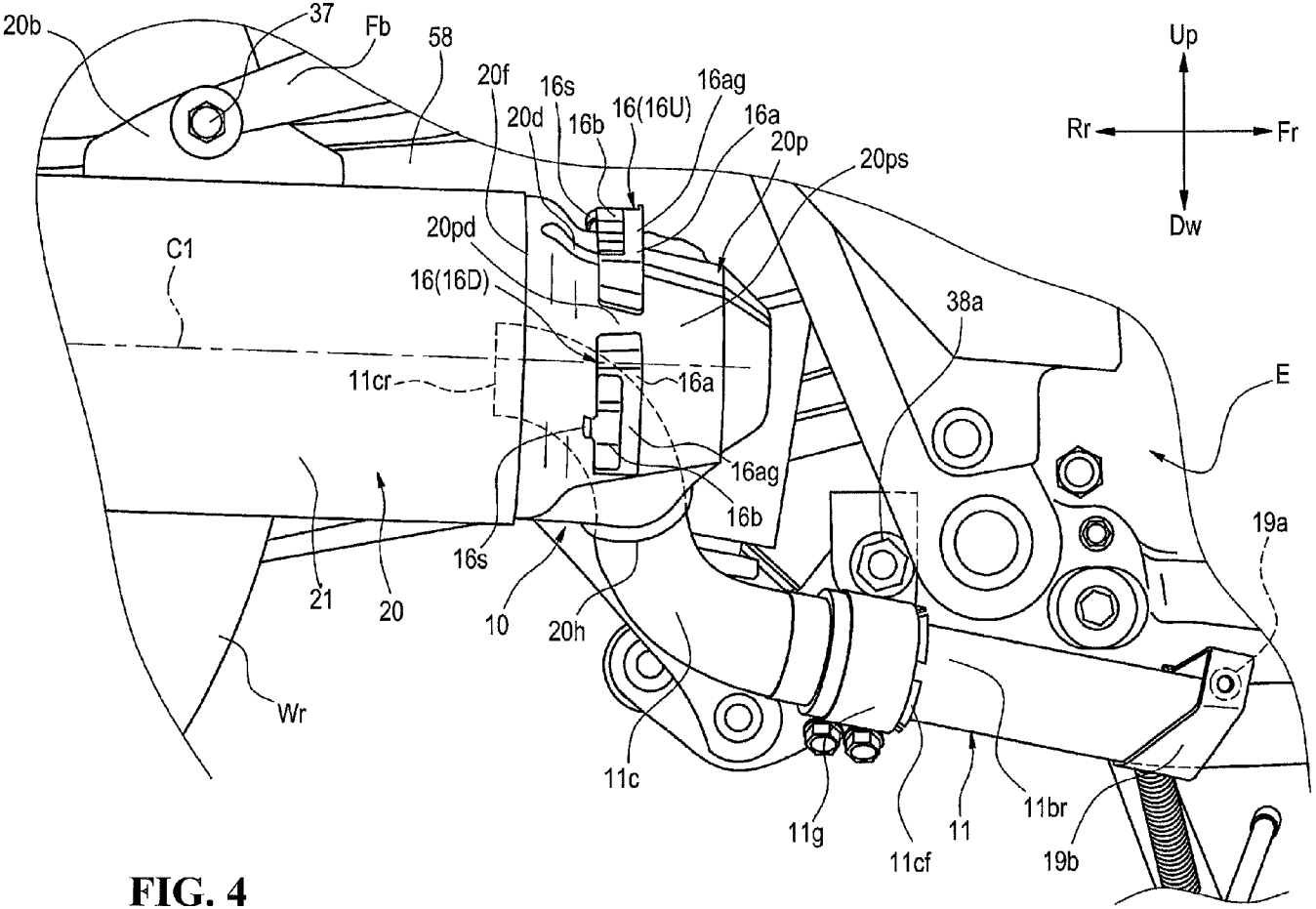
FIG. 4 is a schematic side view of the exhaust system shown in FIG. 1 from which a muffler cover is removed.

The muffler 20 is provided with an attachment bracket 20*b* provided at an upper end of a cylindrical muffler body portion 21 and is fixed to an attachment frame Fb of the vehicle body frame F via a fastening bolt 37 and the like in such a way that the muffler body portion 21 is substantially horizontal. Moreover, as shown in FIG. 4, the muffler coupling pipe portion 11*c* is fixed to a vehicle body lower end via a fixing bracket 11*g* and a fastening member 38*a* with a rear end portion 11*br* of the rightward-curving portion 11*b* inserted into a front end portion 11*cf* of the muffler coupling pipe portion 11*c*.

Figure 3:
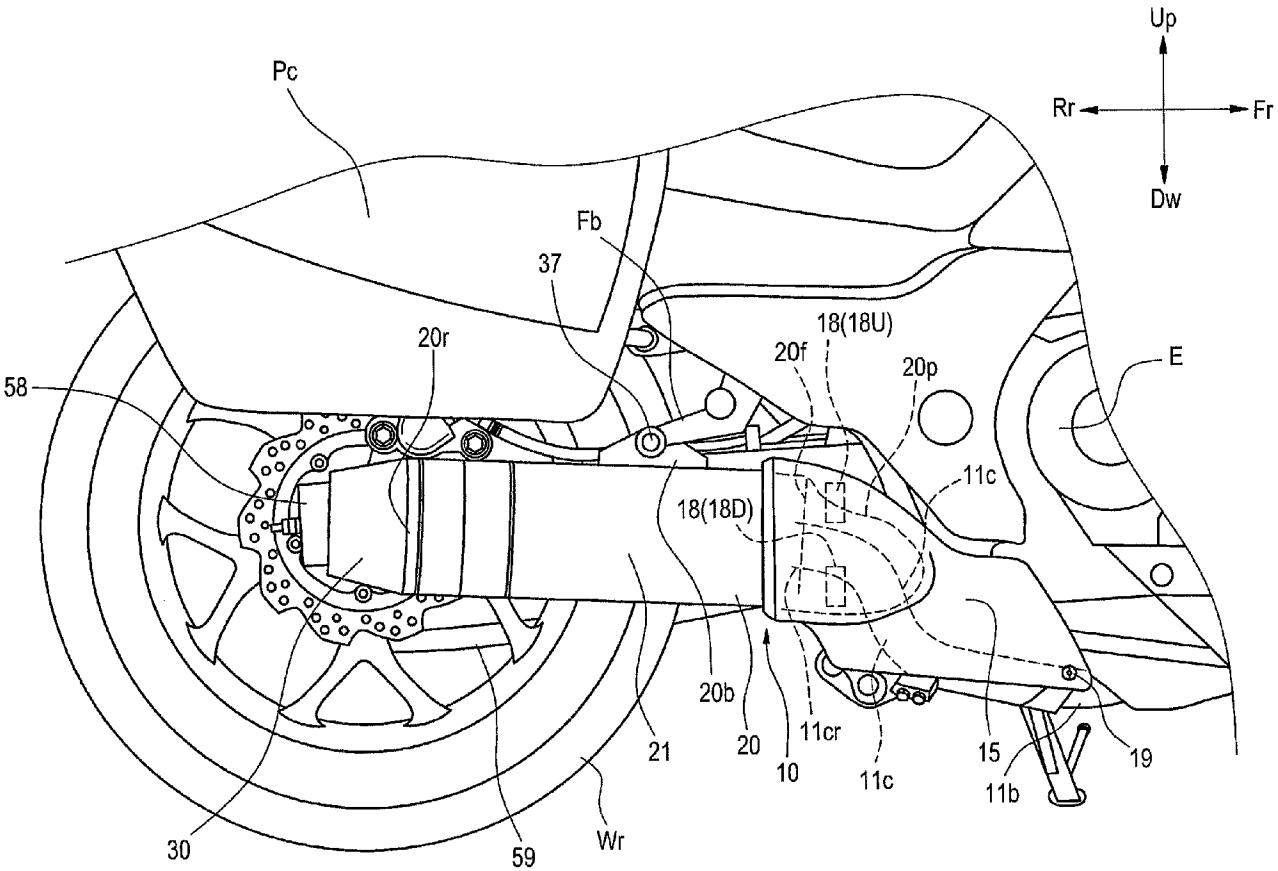
FIG. 3 is an enlarged side view of a main portion of the exhaust system in the saddle-ride type vehicle shown in FIG. 1.

As shown in FIG. 3, the end cap 30 is attached to a muffler rear end portion 20*r* of the muffler 20. Meanwhile, a coupling pipe rear end portion 11*cr* of the muffler coupling pipe portion 11*c* is connected to a muffler front end portion 20*f*. The muffler front end portion 20*f* and the muffler coupling pipe portion 11*c* are covered with a muffler cover 15. A right outer side of the muffler coupling pipe portion 11*c* curving and exposed on the vehicle lateral surface on the same side as the muffler 20 is thus covered with the muffler cover 15 and is made invisible from the lateral side of vehicle.

Figure 5:
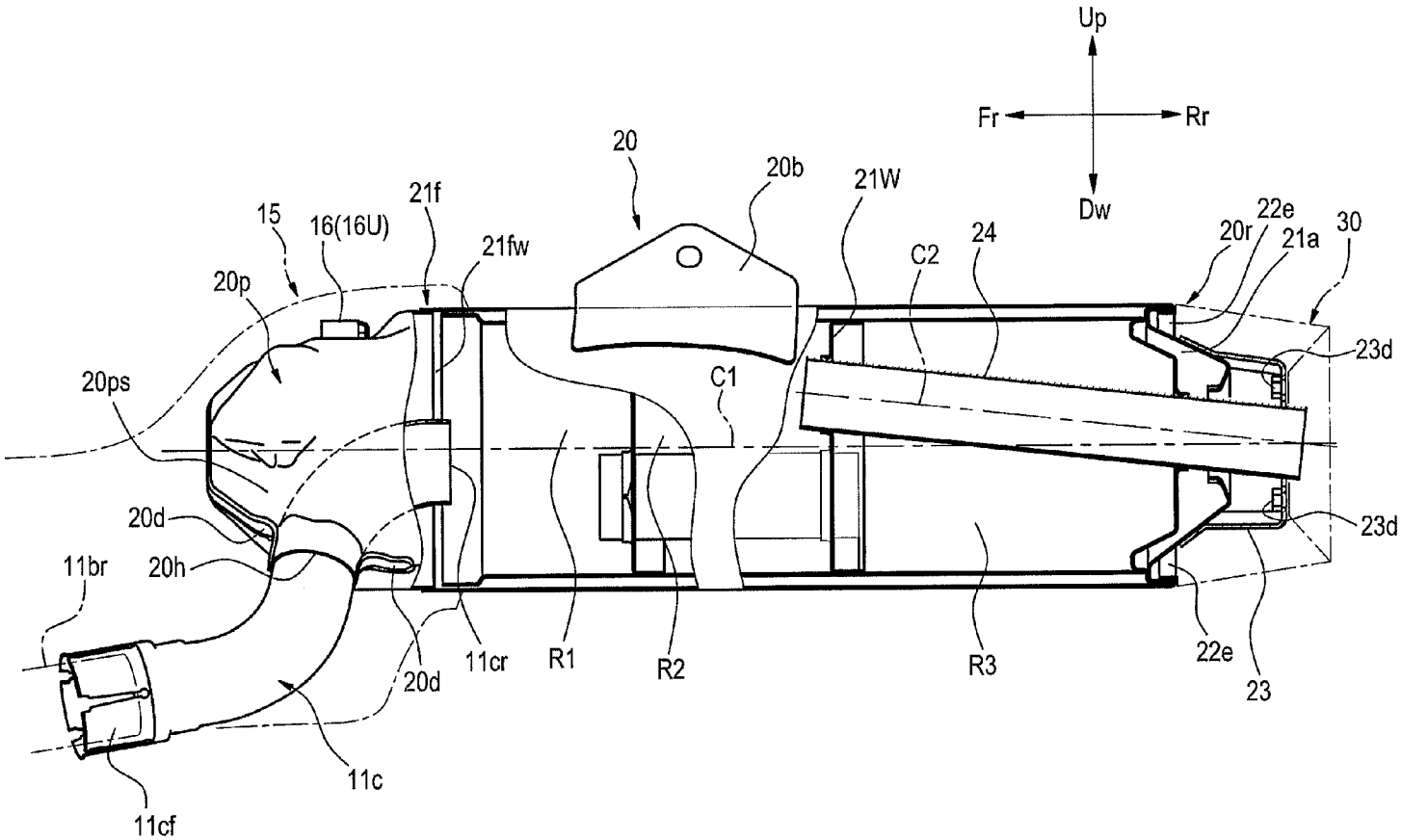
FIG. 5 is a side view as viewed in the vehicle inner side direction in a state where a muffler is attached but the muffler cover is removed.

A description is given of the muffler 20 of the embodiment. For example, as shown in FIG. 5, the interior of the muffler body portion 21 is partitioned into multiple expansion chambers R1, R2, and R3 and a muffler portion and a catalyst are provided therein as needed. An exhaust gas exhausted from the muffler coupling pipe portion 11*c* of the exhaust pipe 11 into the muffler 20 expands in the expansion chambers R1, R2, and R3 and is then exhausted to the outside air from a tail pipe 24. For example, a front end portion of the tail pipe 24 is held by a partitioning wall 21*w* while a rear end portion thereof is held by a closing wall 21*a* of the muffler rear end portion 20*r*. Moreover, the tail pipe 24 is provided in such a way that a tail pipe center axis C2 thereof is appropriately inclined with respect to a muffler center axis C1 of the muffler body portion 21. The end cap 30 attached to the muffler rear end portion 20*r* is fixed to boss portions 23*d* of an end cap stay 23 with fastening members, and is inserted into an end cap insertion portion 22*e* of the muffler rear end portion 20*r* to be attached in a state appearing uniform with the muffler body portion 21.

A description is given below of the muffler cover 15 in the embodiment and the attachment structure thereof.

In the embodiment, as shown in FIG. 4, a front cap 20*p* is attached to the muffler front end portion 20*f* of the muffler body portion 21. An outer surface wall 20*ps* of the front cap 20*p* has such a shape that the diameter thereof becomes smaller toward the front of the vehicle. Moreover, a recessed portion 20*pd* formed to have a diameter smaller than the diameter of the muffler body portion 21 by a large difference H (see FIGS. 6 and 8) is provided in the outer surface wall 20*ps* over the half or more of the circumference thereof (see FIG. 8).

Two engagement receiving parts 16 are provided on the outer surface wall 20*ps* of the recessed portion 20*pd*. More specifically, the two engagement receiving parts 16 include an engagement receiving part 16U provided on the upper side and an engagement receiving part 16D provided on the lower side which are provided with a predetermined interval therebetween in the circumferential direction about the muffler center axis C1. The engagement receiving parts 16 engage with engagement claw parts 17 which are provided on the muffler cover 15 and which will be described later, so that these parts form engagement units 18 (see FIGS. 3 and 7) used to attach the muffler cover 15 to the vehicle body.

Forming the engagement receiving parts 16 on the outer surface wall 20*ps* of the front cap as described above can increase the installation area of the engagement receiving parts 16. Thus, the stiffness of the engagement receiving parts 16 can be easily increased and the muffler cover 15 can be thus firmly fixed. Moreover, installing the engagement receiving parts 16 in the recessed portion 20*pd* deeply recessed from the muffler body portion 21 by the difference H can increase the sizes and the member thicknesses of the engagement receiving parts 16. Thus, the stiffness of the engagement receiving parts 16 can be increased and the muffler cover 15 can be thus firmly fixed. Moreover, since the engagement receiving parts 16 can be formed firmly, the sizes of the engagement claw parts 17 on the muffler cover 15 can be reduced. Reducing the sizes of the engagement claw parts 17 allows the engagement claw parts 17 to be formed irrespective of the shape of the muffler cover. Accordingly, the freedom in the shape of the muffler cover 15 can be improved.

Figure 6:
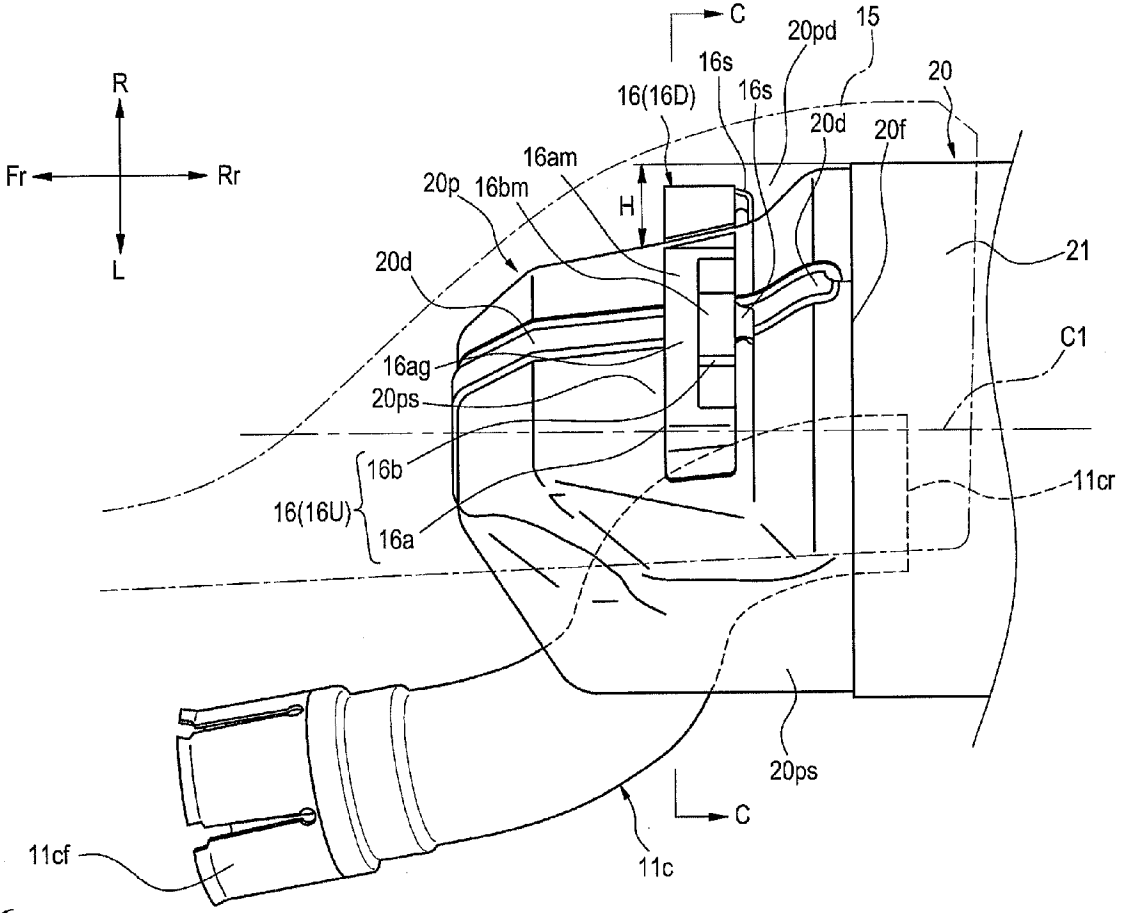
FIG. 6 is a schematic side view of a muffler front portion as viewed from above the vehicle in the state where the muffler is attached but the muffler cover is removed.

A description is given of a connection structure between the front cap 20*p* and the muffler coupling pipe portion 11*c* of the exhaust pipe 11 in the embodiment, with reference to FIGS. 5 and 6. FIG. 5 is a partial breakaway side view of the muffler 20 as viewed from the vehicle left side. FIG. 6 is a plan view of the front cap 20*p* and its vicinity as viewed from above the vehicle.

As shown in FIG. 5, the muffler coupling pipe portion 11*c* extends upwardly and enters the front cap 20*p* from an insertion hole 20*h* provided on the vehicle lower side and on the inner (left) side of the front cap 20*p*. Then, the muffler coupling pipe portion 11*c* curves rearwardly and the coupling pipe rear end portion 11*cr* penetrates a wall surface 20*fw* of the muffler front end portion 20*f* to be coupled to the muffler front end portion 20*f*.

The front cap 20*p* has a dividing portion 20*d* at which the front cap 20*p* is divided into two parts in a substantially vertical direction along the muffler center axis C1. Moreover, the insertion hole 20*h* through which the muffler coupling pipe portion 11*c* is inserted is formed to extend across the dividing portion 20*d*. The position of the insertion hole 20*h* is located on the vehicle lower side and on the inner (left) side as described above. In other words, in a view in the cross sectional direction of the muffler 20, the insertion hole is located in the lower half side of the front cap 20*p* in the vertical direction and on the inner side (see FIG. 8) thereof in the vehicle width direction.

As described above, disposing the muffler coupling pipe portion 11*c* on the lower side and on the inner side of the front cap 20*p* makes the muffler coupling pipe portion 11*c* disposed to be less visible. Moreover, the lateral surface shape of the front cap 20*p* on the vehicle right outer side, i.e. the side on which the muffler cover 15 is mounted can be made simple and complexity of the shape of the muffler cover 15 is avoided. This can contribute to an improvement in appearance. Furthermore, inserting the muffler coupling pipe portion 11*c* into the insertion hole 20*h* extending across the dividing portion 20*d* at which the front cap is 20*p* is divided into two parts can contribute to an improvement in mountability of the muffler coupling pipe portion 11*c* into the front cap 20*p*.

Figure 7:
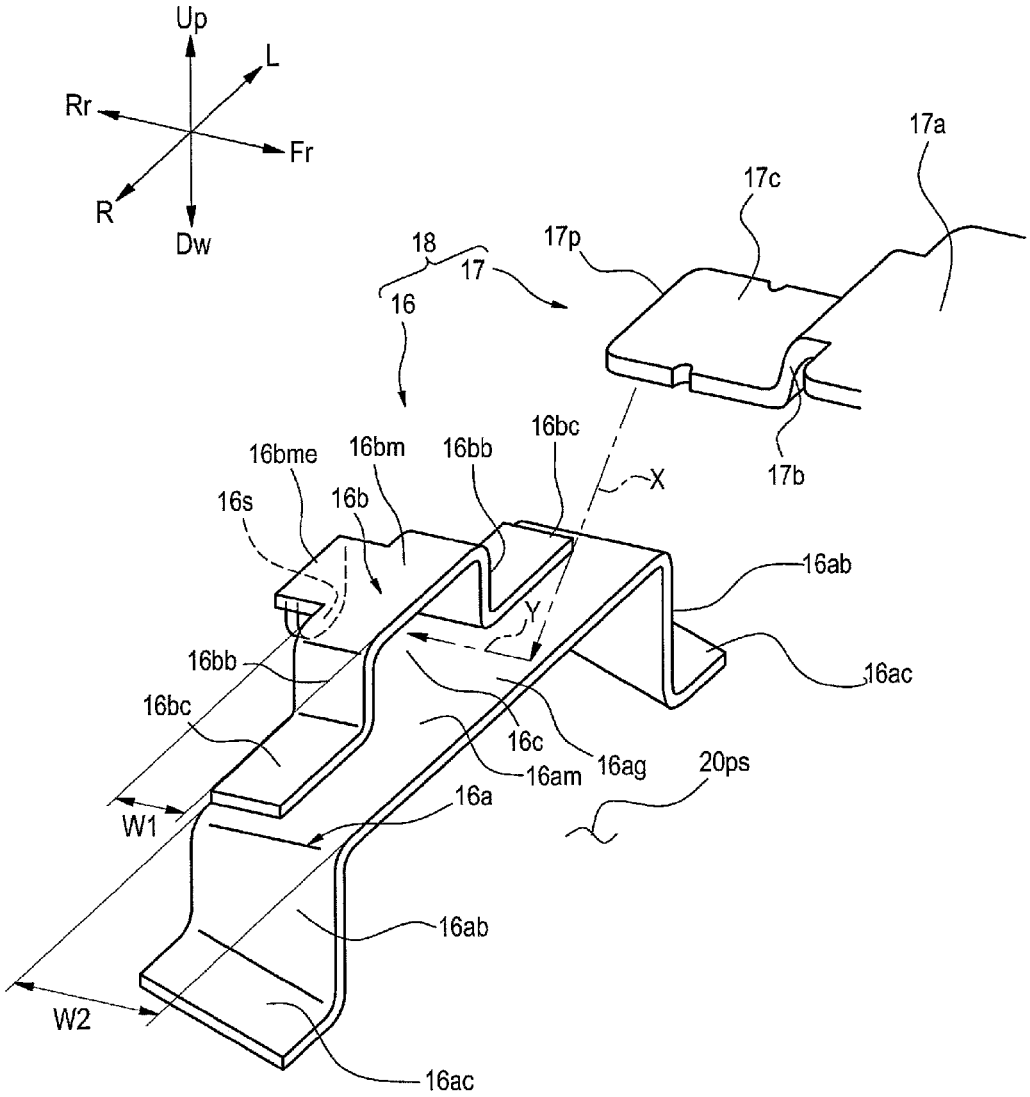
FIG. 7 is a perspective view of an engagement unit shown in FIG. 3.

As shown in FIG. 7, in each of the engagement receiving parts 16 in the embodiment, a base portion 16*a* fixed to the recessed portion 20*pd* and a locking piece 16*b* formed on the base portion 16*a* form a rectangular insertion opening 16*c*.

The base portion 16*a* has a rectangular flat surface portion 16*am* extending substantially in the muffler circumferential direction and also has leg portions 16*ab*, 16*ab* extending in a muffler radial direction from both ends of the flat surface portion 16*am* to a surface of the recessed portion 20*pd*. Fixed portions 16*ac*, 16*ac* fixed to the surface of the recessed portion 20*pd* by welding or the like are formed in the leg portions 16*ab*, 16*ab*.

The locking piece 16*b* has a locking upper end surface portion 16*bm* extending parallel to the flat surface portion 16*am* and locking-part leg portions 16*bb*, 16*bb* extending in the muffler radial direction from both ends of the locking upper end surface portion 16*bm* to the flat surface portion 16*am*. Fixed portions 16*bc*, 16*bc* at front ends of the locking-part leg portions 16*bb*, 16*bb* are fixed to the flat surface portion 16*am* by welding or the like.

Moreover, a protruding portion 16*bme* extending toward the rear of the vehicle is formed in the locking upper end surface portion 16*bm* and a stopper portion 16*s* extending from the protruding portion 16*bme* in the muffler radial direction is also formed. The insertion opening 16*c* having a depth along the muffler center axis (in the vehicle front-rear direction in FIG. 7) is thus formed.

The base portion 16*a* is formed to have a front-rear width W2 which is larger than the front-rear width W1 of the locking piece 16*b*, and the locking piece 16*b* is provided close to the rear of the vehicle. A guide portion 16*ag* which is a flat surface where the flat surface portion 16*am* is largely exposed and used to insert the engagement claw part 17 to be described later is thus formed on the front side of the locking piece 16*b*.

In the embodiment, the two sets of engagement units 18, 18 each formed of the engagement receiving part 16 and the engagement claw part 17 are provided as described above and, as shown in FIG. 8, the engagement units 18, 18 are formed at positions on the vehicle right outer side, i.e. on the outer side of a vertical line LR passing through the muffler center axis C1, in the muffler circumferential direction. Moreover, the engagement receiving part 16U forming the upper engagement unit 18U out of the engagement units 18, 18 is disposed at a position above a horizontal line UD passing through the muffler center axis C1 while the engagement receiving part 16D forming the lower engagement unit 18D is disposed at a position below the horizontal line UD.

Figure 8:
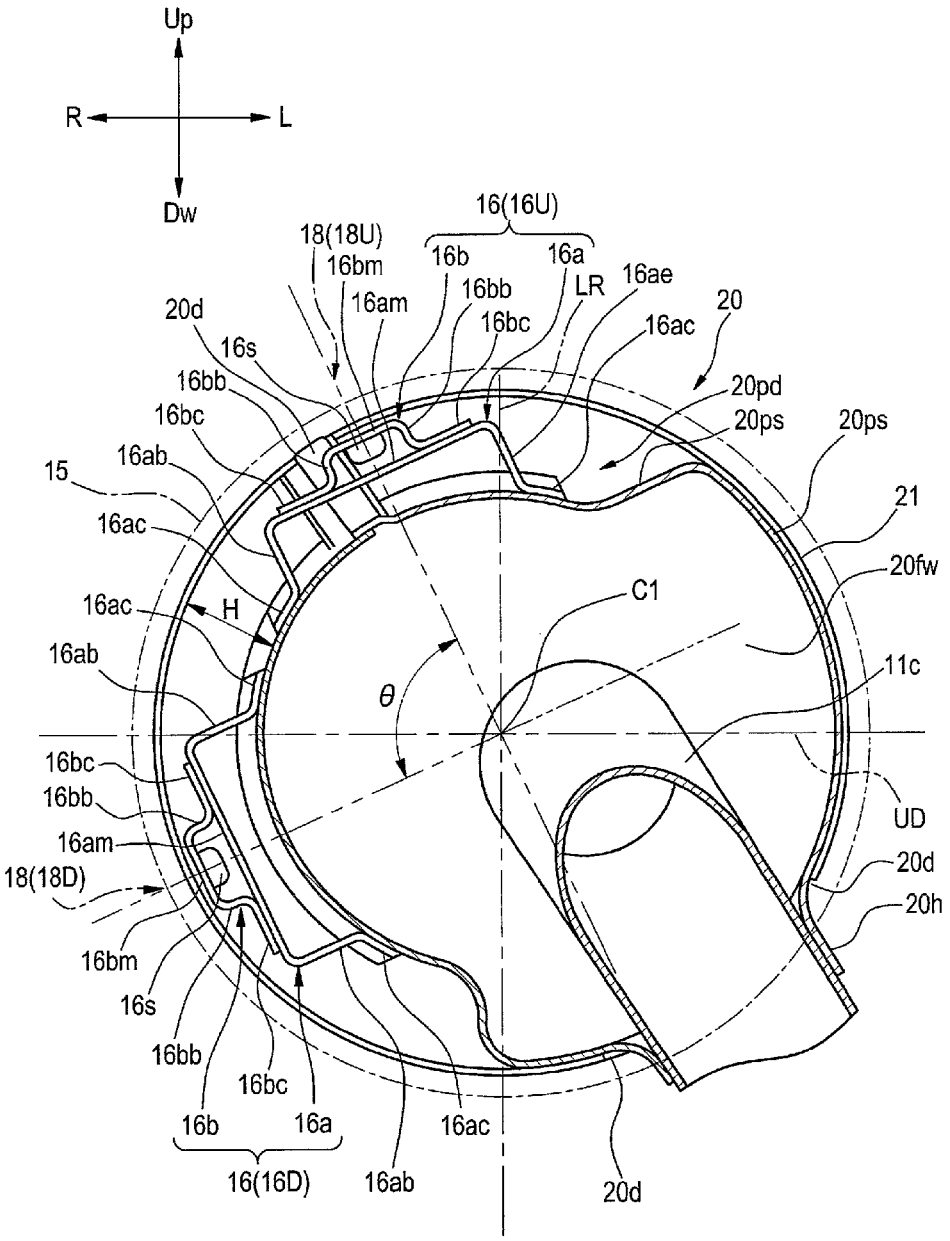
FIG. 8 is a cross-sectional view taken along the C-C line of FIG. 6.

Furthermore, the engagement receiving part 16U and the engagement receiving part 16D forming the two sets of the engagement units 18, 18, respectively, are formed to have such a positional relationship that, for example, as shown in FIG. 8, the separation angle θ between their positions is substantially 90° in the circumferential direction about the muffler center axis C1.

Disposing the engagement units 18, 18 at an interval of substantially 90° in the circumferential direction about the muffler center axis C1 as described above allows the engagement units 18, 18 to support the muffler cover 15 with a large interval therebetween in a horizontal cross-section direction of the muffler cover 15. Accordingly, their force for supporting the muffler cover 15 can be increased.

Figure 9:
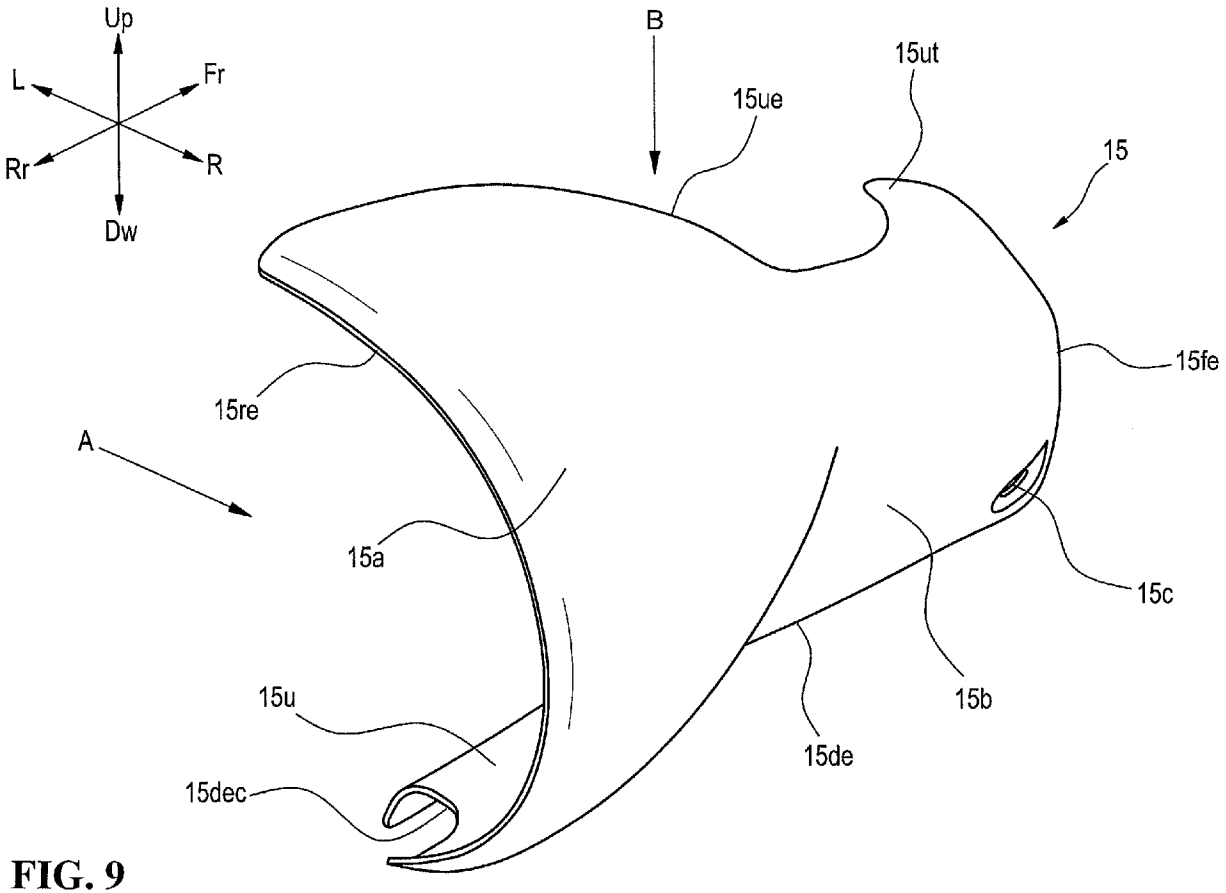
FIG. 9 is a perspective view of the muffler cover shown in FIG. 1.

The muffler cover 15 of the embodiment is described with reference to FIGS. 9 to 11. FIG. 9 shows a perspective view of the muffler cover 15, FIG. 10 shows a back surface of the muffler cover 15 as viewed in the direction of the arrow A in FIG. 9, and FIG. 11 shows a plan of the muffler cover 15 as viewed in the direction of the arrow B in FIG. 9.

As shown in FIG. 9, the muffler cover 15 is formed of a substantially semi-circular cover rear portion 15*a* covering the exteriors of the muffler front end portion 20*f* and the front cap 20*p* and a cover front portion 15*b* extending rearward of the cover rear portion 15*a* and extending toward the front of the vehicle to cover the exterior of the muffler coupling pipe portion 11*c* of the exhaust pipe 11. In the muffler cover 15, the curve of the cover rear portion 15*a* is shaped in the form of a curved surface that is substantially semi-cylindrical and tapered toward the front along the shape of the substantial half of the front cap 20*p*. On the other hand, the cover front portion 15*b* is shaped in the form of a curved surface having a bulge toward the outer side of the vehicle smaller than that of the cover rear portion 15*a*. In other words, the muffler cover 15 has a curvature varying in the vehicle front-rear direction and has a curved three-dimensional shape smoothly bulging toward the outer side of the vehicle as a whole.

A description is given of a profile shape of the muffler cover 15 as viewed in a back surface direction thereof.

Figure 10:
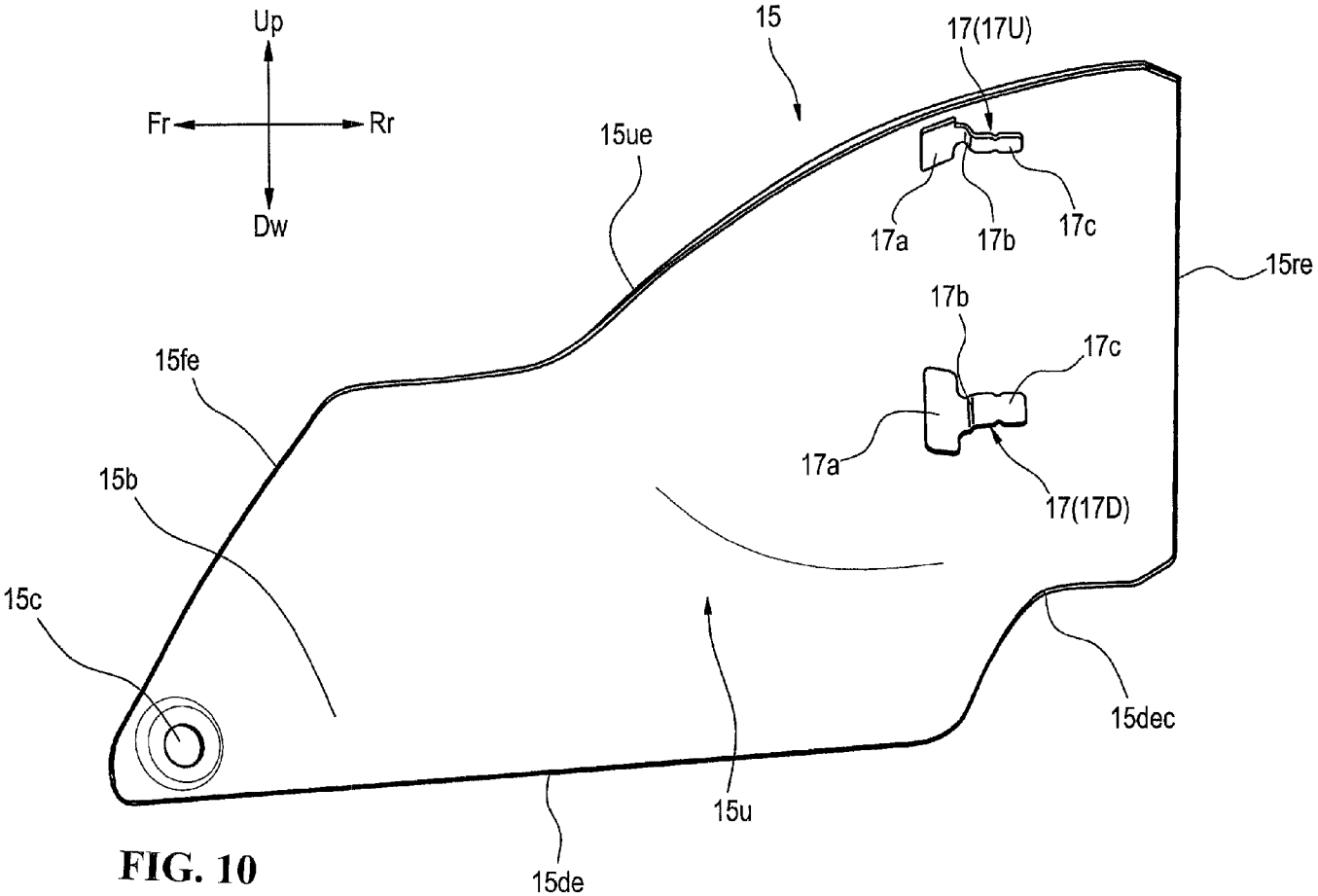
FIG. 10 is a side view of the muffler cover shown in FIG. 9 as viewed in the direction of the arrow A.
Figure 11:
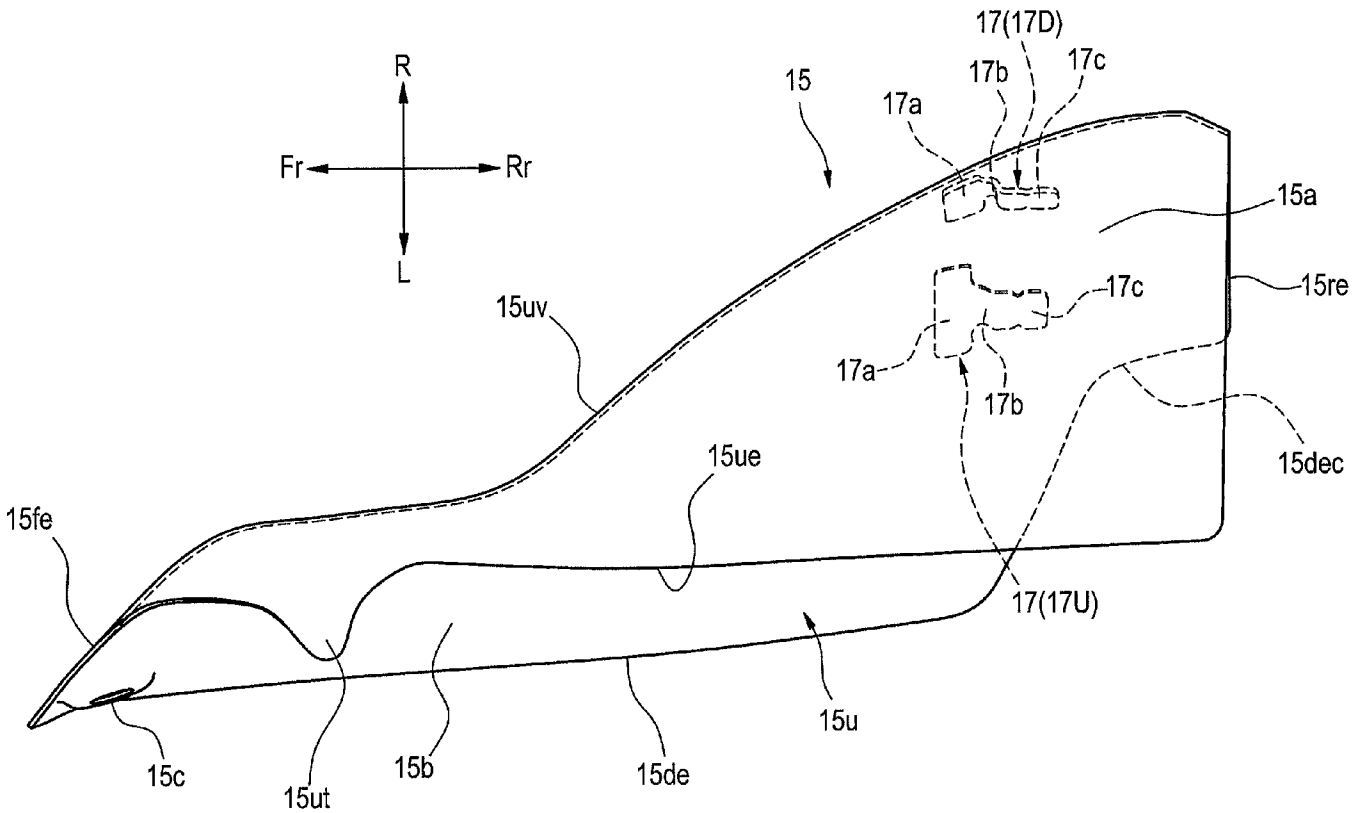
FIG. 11 is a plan view of the muffler cover shown in FIG. 9 as viewed in the direction of the arrow B.

As shown in FIG. 10, an upper edge 15*ue* of the muffler cover 15 in the cover rear portion 15*a* is high and is entirely curved to bulge outwardly while the upper edge 15*ue* on the vehicle front side is low and extends horizontally. Meanwhile, a lower edge 15*de* extends substantially horizontally except in a curved recessed portion 15*dec* on the rear end side. Moreover, a front edge 15*fe* extends obliquely forward toward the lower edge 15*de*. Furthermore, a rear edge 15*re* extends substantially vertically.

Moreover, as shown in FIG. 11, the upper edge 15*ue* and the lower edge 15*de* extend in the vehicle front-rear direction, the front edge 15*fe* is inclined obliquely forward toward the vehicle inner side (vehicle left side), and the rear edge 15*re* extends parallel to the vehicle left-right direction. An outer bulging profile 15*uv* is formed to have a smooth curve of two stages that extends rearwardly from the front side. A bulging portion 15*ut* bulging toward the inner side of the vehicle along the shape of the vehicle is formed on a front side of the upper edge 15*ue*.

As described above, the muffler cover 15 covers the lateral sides and the upper sides of the muffler front end portion 20*f*, the front cap 20*p*, and the muffler coupling pipe portion 11*c* with a smoothly curved surface and the appearance of the vehicle is thereby improved.

The structure of the muffler cover 15 on the back surface side is described below.

In the muffler cover 15, the two engagement claw parts 17 (17U, 17D) are provided on a back surface 15*u* of the cover rear portion 15*a* and a bolt hole 15*c* for an attachment bolt is provided in a front lower end portion.

The engagement claw parts 17, 17 are disposed to correspond to the engagement receiving parts 16, 16 described above with an interval provided between the upper engagement claw part 17U and the lower engagement claw part 17D in the muffler circumferential direction. The upper engagement claw part 17U corresponds to the engagement receiving part 16U in such a way that these parts form the upper engagement unit 18U while the lower engagement claw part 17D corresponds to the engagement receiving part 16D in such a way that these parts form the lower engagement unit 18D.

The structure of each of the engagement claw parts 17 is as follows. The engagement claw part 17 includes a fixed portion 17*a* fixed to the back surface 15*u*. A rising portion 17*b* rising toward the inner side of the cover from a rear end of the fixed portion 17*a* is formed. Furthermore, a claw portion 17*c* extending toward the rear of the vehicle from the rising portion 17*b* is formed. The engagement claw part 17 is formed in such a way that all of its portions are located on the back surface 15*u* of the muffler cover 15 and cannot be seen from the front side of the muffler cover 15 at all. Accordingly, the engagement claw part 17 is completely covered with the muffler cover 15 and is reliably protected.

An attachment operation of the muffler cover 15 in the embodiment is described.

In a case of attaching the muffler cover 15, first, the muffler cover 15 is placed in such a way that the cover rear portion 15*a* is made to correspond to the front cap 20*p*. In this placing operation, the upper engagement claw part 17U is made to correspond to the engagement receiving part 16U while the lower engagement claw part 17D is made to correspond to the engagement receiving part 16D. In this case, since both of the engagement units 18, 18 are formed on the vehicle outer side, both of the engagement units 18, 18 can be easily visually checked and the operability is thus good.

Moreover, in the engagement of both of the engagement units 18, 18, the muffler cover 15 is placed in such a way that the claw portions 17*c* of the engagement claw parts 17 are brought into contact with the guide portions 16*ag* of the engagement receiving parts 16 when the engagement claw parts 17 and the engagement receiving parts 16 are brought into contact for the first time (operation in the direction of the arrow X in FIG. 7).

Thereafter, the claw portions 17*c* are pressed toward the rear side of the muffler cover 15 to slide along the guide portions 16*ag* toward the rear side of the vehicle (in a direction along the muffler center axis C1). At this time, although the engagement state of both of the engagement units 18, 18 are not visible, the claw portions 17*c* are guided by the guide portions 16*ag* and are inserted into the insertion openings 16*c* (operation in the direction of the arrow Y in FIG. 7).

In this insertion operation, front ends 17*p* of the claw portions 17*c* come into contact with the stopper portions 16*s* and the insertion operation of the muffler cover 15 is thereby forced to stop. Thereafter, the muffler cover 15 is fixed by screwing an attachment bolt 19 into a boss portion 19*a* through the bolt hole 15*c*.

Providing the engagement receiving parts 16 with the guide portions 16*ag* extending along the muffler center axis C1 continuously with the insertion openings 16*c* allows the engagement claw parts 17 to be positioned by being brought into contact with the guide portions 16*ag* when the muffler cover 15 is attached as described above. Moreover, even if the engagement units 18, 18 are not visible, the engagement claw parts 17 can be inserted into the insertion openings 16*c* by sliding on the guide portions 16*ag* and the mounting is thus extremely easy. Furthermore, providing the engagement receiving parts 16 with the stopper portions 16*s* restricting the insertion amount of the engagement claw parts 17 on the opposite side to the insertion openings 16*c* allows the engagement claw parts 17 to be inserted by a proper amount even when the engagement claw parts 17 are not visible in the attachment of the muffler cover 15. Moreover, the completion of the insertion operation can be recognized by the contact of the engagement claw parts 17 with the stopper portions 16*s* and the mounting operation is thus extremely easy.

The embodiment to which the present invention is applied is described but the present invention is not limited to this. For example, the shape of the muffler cover 15, the shape of the engagement receiving parts 16, the shape of the engagement claw parts 17, the arrangement angle of the engagement units 18, 18, the number of engagement units 18, the shape of the front cap 20*p*, and the like are not limited to those of the embodiment described above and can be changed as appropriate.

Moreover, in the embodiment described above, the description is given of the motorcycle. However, the present invention is not limited to this and can be applied to other saddle-ride type vehicles such as three-wheel vehicles and four-wheel vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system of a saddle-ride vehicle that includes a cylindrical muffler connected to an exhaust pipe for exhausting exhaust from an engine and provided with a front cap on a front side of a muffler body portion and which has a muffler cover covering part of the exhaust pipe and the front cap, comprising:

a plurality of engagement units formed respectively of a plurality of engagement receiving parts and a plurality of engagement claw parts;

said engagement receiving parts being provided on an outer surface wall of the front cap with an interval therebetween in a circumferential direction about a muffler center axis of the muffler;

said engagement claw parts corresponding respectively to the plurality of engagement receiving parts and being disposed on a back surface of the muffler cover, and further including insertion openings extending along the muffler center axis in a vehicle front-rear direction, said insertion opening being provided in the respective engagement receiving parts;

claw portions configured to be inserted into the insertion openings, said claw portions being provided in the respective engagement claw parts; and guide portions are provided on front sides of the respective insertion openings, the guide portions being configured to guide the claw portions to the insertion openings and continuous with the insertion openings.

2. The exhaust system of a saddle-ride vehicle according to claim 1, wherein the insertion openings are respectively provided with stopper portions on a front side thereof in an insertion direction of the engagement claw parts, the stopper portions configured to restrict insertion amounts of the engagement claw parts.

3. The exhaust system of a saddle-ride vehicle according to claim 2, wherein the insertion openings are respectively provided with stopper portions on a front side thereof in an insertion direction of the engagement claw parts, the stopper portions configured to restrict insertion amounts of the engagement claw parts.

4. The exhaust system of a saddle-ride vehicle according to claim 1, wherein:

two of the engagement units are provided; and in a view in the vehicle front-rear direction, both of the engagement units are disposed on a vehicle outer side of a vertical line passing through the muffler center axis, and one of the engagement units is disposed above a horizontal line passing though the muffler center axis while another engagement unit is disposed below the horizontal line.

5. The exhaust system of a saddle-ride vehicle according to claim 2, wherein:

two of the engagement units are provided; and in a view in the vehicle front-rear direction, both of the engagement units are disposed on a vehicle outer side of a vertical line passing through the muffler center axis, and one of the engagement units is disposed above a horizontal line passing though the muffler center axis while another engagement unit is disposed below the horizontal line.

6. The exhaust system of a saddle-ride vehicle according to claim 4, wherein the two engagement units are disposed at an interval of substantially 90° in the circumferential direction about the muffler center axis.

7. The exhaust system of a saddle-ride vehicle according to claim 1, wherein:

the exhaust pipe extends to one side in a vehicle left-right direction, and then extends across a vehicle center to another side; and a muffler coupling pipe portion of the exhaust pipe disposed on the same side as the muffler is covered with the muffler cover.

8. The exhaust system of a saddle-ride vehicle according to claim 2, wherein:

the exhaust pipe extends to one side in a vehicle left-right direction, and then extends across a vehicle center to another side; and a muffler coupling pipe portion of the exhaust pipe disposed on the same side as the muffler is covered with the muffler cover.

9. The exhaust system of a saddle-ride vehicle according to claim 1, wherein the exhaust pipe enters an insertion hole formed on a vehicle lower side of the front cap, in a direction intersecting the muffler center axis, and is coupled to a muffler front end portion while extending along the muffler center axis.

10. The exhaust system of a saddle-ride vehicle according to claim 2, wherein the exhaust pipe enters an insertion hole formed on a vehicle lower side of the front cap, in a direction intersecting the muffler center axis, and is coupled to a muffler front end portion while extending along the muffler center axis.

11. The exhaust system of a saddle-ride vehicle according to claim 9, wherein the insertion hole is located at a position on a lower half side of the muffler in a vertical direction and on an inner side thereof in a vehicle width direction.

12. The exhaust system of a saddle-ride vehicle according to claim 9, wherein:

the front cap has a dividing portion at which the front cap is divided into two parts substantially along the muffler center axis, and the insertion hole is formed to extend across the dividing portion.

13. An exhaust system of a saddle-ride vehicle comprising:

a cylindrical muffler connected to an exhaust pipe for exhausting exhaust from an engine;

a front cap mounted on a front side of a muffler body portion;

a muffler cover for covering part of the exhaust pipe and the front cap;

a plurality of engagement receiving parts, said engagement receiving parts being provided on an outer surface wall of the front cap with an interval therebetween in a circumferential direction about a muffler center axis of the muffler; and a plurality of engagement claw parts, said engagement claw parts corresponding respectively to the plurality of engagement receiving parts and being disposed on a back surface of the muffler cover, and further including insertion openings extending along the muffler center axis in a vehicle front-rear direction, said insertion opening being provided in the respective engagement receiving parts;

claw portions configured to be inserted into the insertion openings, said claw portions being provided in the respective engagement claw parts; and guide portions are provided on front sides of the respective insertion openings, the guide portions being configured to guide the claw portions to the insertion openings and continuous with the insertion openings.

14. The exhaust system of a saddle-ride vehicle according to claim 13, wherein the insertion openings are respectively provided with stopper portions on a front side thereof in an insertion direction of the engagement claw parts, the stopper portions configured to restrict insertion amounts of the engagement claw parts.

15. The exhaust system of a saddle-ride vehicle according to claim 13, wherein:

two of the engagement units are provided; and in a view in the vehicle front-rear direction, both of the engagement units are disposed on a vehicle outer side of a vertical line passing through the muffler center axis, and one of the engagement units is disposed above a horizontal line passing though the muffler center axis while another engagement unit is disposed below the horizontal line.

16. An exhaust system of a saddle-ride vehicle comprising:

a cylindrical muffler connected to an exhaust pipe for exhausting exhaust from an engine;

a front cap mounted on a front side of a muffler body portion;

a muffler cover for covering part of the exhaust pipe and the front cap;

a plurality of engagement receiving parts, said engagement receiving parts being provided on an outer surface wall of the front cap with an interval therebetween in a circumferential direction about a muffler center axis of the muffler; and a plurality of engagement claw parts, said engagement claw parts corresponding respectively to the plurality of engagement receiving parts and being disposed on a back surface of the muffler cover, wherein insertion openings are respectively provided with stopper portions on a front side thereof in an insertion direction of the engagement claw parts, the stopper portions configured to restrict insertion amounts of the engagement claw parts.

17. The exhaust system of a saddle-ride vehicle according to claim 16, wherein:

two of the engagement units are provided; and in a view in the vehicle front-rear direction, both of the engagement units are disposed on a vehicle outer side of a vertical line passing through the muffler center axis, and one of the engagement units is disposed above a horizontal line passing though the muffler center axis while another engagement unit is disposed below the horizontal line.

18. The exhaust system of a saddle-ride vehicle according to claim 16, wherein:

the exhaust pipe extends to one side in a vehicle left-right direction, and then extends across a vehicle center to another side; and a muffler coupling pipe portion of the exhaust pipe disposed on the same side as the muffler is covered with the muffler cover.

19. The exhaust system of a saddle-ride vehicle according to claim 16, wherein the exhaust pipe enters an insertion hole formed on a vehicle lower side of the front cap, in a direction intersecting the muffler center axis, and is coupled to a muffler front end portion while extending along the muffler center axis.

* * * * *